United States Patent [19]

Orasche et al.

[11] Patent Number: 4,981,264

[45] Date of Patent: Jan. 1, 1991

[54] DEVICE FOR FIXING STOCK RAILS IN RAILWAY SWITCHES AS WELL AS PROCESS FOR FIXING STOCK RAILS BY MEANS OF SUCH DEVICE

[75] Inventors: Hermann Orasche; Johann Rieger, both of Zeltweg, Austria

[73] Assignee: Voest-Alpine Maschinenbau Gesellschaft m.b.H., Linz, Austria

[21] Appl. No.: 353,025

[22] Filed: May 17, 1989

[30] Foreign Application Priority Data

May 20, 1988 [AT] Austria ..... 1335/88

[51] Int. Cl.[5] ..... E01B 9/34; E01B 9/00

[52] U.S. Cl. ..... 238/333; 238/331

[58] Field of Search ..... 238/39, 201–203, 238/282, 283, 331, 333; 246/385, 430

[56] References Cited

U.S. PATENT DOCUMENTS

| | | | |
|---|---|---|---|
| 966,284 | 8/1910 | Williamson | 238/331 |
| 2,462,771 | 2/1949 | Philips | 238/331 |

FOREIGN PATENT DOCUMENTS

| | | |
|---|---|---|
| 321345 | 3/1975 | Austria . |
| 646413 | 6/1937 | Fed. Rep. of Germany . |
| 3230612 | 8/1982 | Fed. Rep. of Germany . |

*Primary Examiner*—Robert P. Olszewski
*Assistant Examiner*—A. Muratori
*Attorney, Agent, or Firm*—Cushman, Darby & Cushman

[57] ABSTRACT

In a device for fixing stock rails (1) in railway switches, including a base plate (2) for the stock rail (1) and a sliding chair (3) for the switch tongue mounted on the base plate and comprising an elongated spring element (6) for pressing down the rail foot and preferably having the shape of a plate, the spring element (6) can be introduced, preferably without tension, into a tunnel-shaped recess (5) provided in the sliding chair (3) and extending in a direction approximately normal to the stock rail. The upper edge of the tongue-shaped recess (5) within the sliding chair (3) extends, with the formation of a kink (13), in direction towards the rail foot steeper in upward direction that in an area (11) extending more flatly in front of the kink (13). A separate wedge (10) can, for the purpose of guying the spring element (6) against the rail foot, be driven in within the area (11) of flatter extension of the upper edge at a distance from the kink (13) of the upper edge. On account of the wedges presence, a progressive spring characteristic of the spring element (6) can easily be adapted to the requirements.

5 Claims, 2 Drawing Sheets

DEVICE FOR FIXING STOCK RAILS IN RAILWAY SWITCHES AS WELL AS PROCESS FOR FIXING STOCK RAILS BY MEANS OF SUCH DEVICE

BACKGROUND OF THE INVENTION

1. Field of the Invention

The invention relates to a device for fixing stock rails in railway switches. The invention also relates to a process for fixing stock rails by means of such a device.

2. Description of the Prior Art

A device of the above mentioned type is taught in, for example, AT-PS 321 345. By means of such a device, there was achieved the advantage that a plate-shaped spring element could be introduced under substantially no tension and was brought into the desired tensioned position, in which the rail foot was resiliently held in position, only by running the cotter or cross-wedge into position. No special tools were necessary for assembly and the spring leaf could simply be put into the desired position, whereupon the desired tension was adjusted by the wedge.

DE-OS 32 30 612, teaches a device for fixing stock rails or track rails in railway switches, in which a spring element having a round shape, was under tension in a tunnel-shaped recess of a sliding chair for the purpose of obtaining in this manner a resilient fixation of a rail foot. In such known constructions it had been found that in cases of excessive stress there exists the risk that the spring element may become fractured. In particular, it has been found that a substantially lower spring force and thus a lower load of the spring element can be considered as sufficient in normal operation, whereas a progressive spring characteristic would be desirable in cases of a heavy load. An attempt to realize such a progressive spring characteristic is made in DE-OS 32 30 612, and for this purpose there is provided in the tunnel-shaped recess beside a first hump-shaped elevation, over which the spring element is run so as to put the spring element under pretension, a second hump-shaped elevation and the rail root. Such an arrangement results in a sliding chair of relatively complicated design. On account of using in this arrangement spring elements formed of bent round steel, the spring characteristic becomes extremely steep after having engaged the second hump-shaped elevation, so that a definite progressive spring characteristic can not be obtained easily. Furthermore, machining of the sliding chair and the design of the tunnel-shaped recess of the sliding chair are relatively expensive in this construction.

SUMMARY OF THE INVENTION

The invention now aims at providing a simple design of the tunnel-shaped recess of a sliding chair such that the recess can be produced with the required precision with no difficulties. The invention further aims at providing the possibility to adapt the progressive spring characteristic of a plate-shaped spring element to the desired requirements in a simple and straightforward manner. For solving this problem, the inventive design of the fixing device of the type initially mentioned essentially consists of an upper edge of the tunnel-shaped recess within the sliding chair extending, under the formation of a kink, steeper in direction to the rail foot than within an area of smaller inclination located in front of said kink, and the separate wedge can be run in within the area of smaller inclination of the upper edge at a distance from the kink of the upper edge. On account of the upper edge of the tunnel-shaped recess within the sliding chair extending, under the formation of a kink, steeper in direction to the rail foot, there can be produced according to production techniques an exact transition between the first partial area of the tunnel-shaped recess and the second partial area facing the rail foot, noting that there a limiting stop can simultaneously be realized for the progressively extending partial area of the spring path by the partial area extending in an upward direction with a greater inclination. On account of now using a separate wedge, such as in the construction according to the Austrian Patent Specification No. 321 345, it can be ascertained that the plate-shaped spring element assumes, after running in the wedge, its position in the tunnel-shaped recess of the sliding chair at a distance from the kink so that the progressive spring characteristic is in fact observed after a predetermined spring path. The process for fixing stock rails by means of such a device is performed advantageously such that the separate wedge is run in so that the spring element is brought a predetermined vertical distance from the location of the kink within the tunnel-shaped recess. By running in the wedge, the length of the spring path having the flatter spring characteristic can be exactly predetermined according to the requirements, and after collision of the plate-shaped spring element with the location of the kink in the tunnel-shaped recess, there is obtained a steeper spring characteristic which is limited after engaging a stop on the steeper area of the tunnel-shaped recess after a predetermined spring path.

The arrangement is selected advantageously such that the upper edge of the tunnel-shaped recess is formed, as seen in a longitudinal section, of two sections that extend along straight lines and, as seen in direction of the recess, form a salient angle. Such an arrangement can be produced in a simple manner without the risk of reducing the strength of the sliding chair resulting in a relatively exactly defined abutment point for the beginning of the progressive spring characteristic after a first spring path with smaller spring force.

In this case, the arrangement is selected such that the salient angle is within the range of from 185° to 205°, noting that such an angle has been proven as particularly preferable, particularly in consideration of the desired strength of the sliding chair.

For the practical operation, it is particularly advantageous if the progressive spring characteristic, within a certain spring path, can be obtained according to a characteristic which is substantially flatter as can be obtained by a second abutment when using springs being formed of bent, round material. Thus, a progressive spring characteristic is obtained that still extends comparatively flat and substantially differs from an abutment on the steeper extending partial area of the tunnel-shaped recess. For this purpose, the arrangement is selected such that the distance between the additional wedge and the end, gripping over the rail foot, of the spring leaf is 25 to 100 percent greater than the distance between the kink of the upper edge and the end of the leaf spring which grips over the rail foot.

By using a substantially plate-shaped spring element, there can be obtained a progressive spring characteristic wherein the mutually adjoining partial areas of the spring characteristic are still of comparably flat extension as compared with an abutment, so that the spring element is simultaneously, reliably and effectively secured against fracture.

BRIEF DESCRIPTION OF THE DRAWINGS

The invention is better understood by studying the following detailed description with reference to the embodiment shown in the drawings, wherein.

DETAILED DESCRIPTION OF THE PREFERRED EMBODIMENTS

Figure 1:
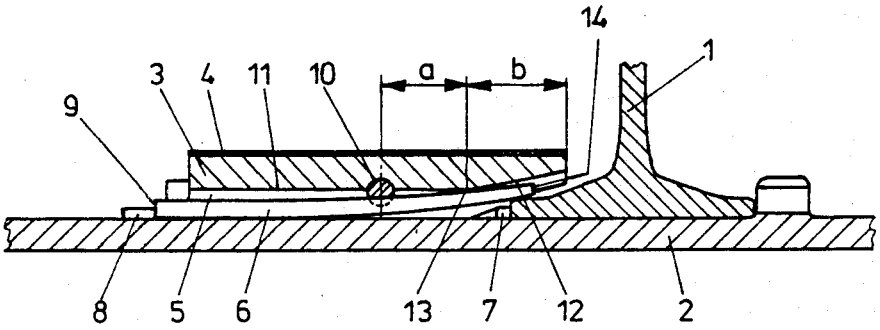
FIG. 1 shows a section through a device for fixing stock rails in railway switches and more exactly, a section through a sliding chair according to the present invention.

In FIG. 1, there is designated by the reference numeral 1 a stock rail or, respectively, it foot resting on a base plate 2. The sliding chair is designated by 3 and has on its surface a layer 4 of anti-friction material. The sliding chair 3 has a tunnel-shaped recess 5 into which is shifted a plate-shaped spring element 6 for holding down the rail foot of the stock rail 1. At the side facing the sliding chair 3, the rail foot is secured by an abutment 7 welded on the base plate 2, noting that, for the purpose of securing the plate-shaped spring element in its operating position, there is provided a stop 8 being welded onto the base plate 2 and cooperating with that end 9 of the plate-shaped spring element 6, which is removed from the stock rail 1.

During assembly, the spring element 6 is introduced without tension into the tunnel-shaped recess 5 of the sliding chair 3, whereupon a cross-wedge or cotter 10 is forcibly driven between the upper edge of the tunnel-shaped recess 5 and the plate-shaped spring element 6 for the purpose of guying the spring element 6 against the rail foot 1. The upper edge of the tunnel-shaped recess 5 of the sliding chair 3 has, as shown, two areas 11 and 12 which extend with different inclinations and form a kink 13. The area 12 facing the rail foot 1 extends, as shown, steeper in an upward direction than the area 11 of the upper edge of the tunnel-shaped recess 5 of the sliding chair 3. The wedge 10, for the purpose of clamping the spring element 6 against the rail foot 1, is forcibly driven in within the area of flatter extension at a distance from the kink 13.

The two sections 11 and 12 forming the upper edge of the tunnel-shaped recess 5 and extending along straight lines include therebetween a salient angle being within the range of from 185° to 205°.

The cross-wedge or cotter 10 is forcibly run in at a distance a from the kink 13 between the areas 11 and 12, the distance a being, at most, equal the distance b between the end 14 of the plate-shaped spring element 6 gripping over the rail foot 1 and the kink 13. In an unloaded condition of the stock rail, the distance a is selected such that the plate-shaped spring element 6 is located, after having run in the wedge 10, at a predetermined vertical distance from the kink 13. In the case of a tilting movement of the stock rail, there acts first on the rail foot 1 a spring force being defined by the total length of the spring element 6, whereupon the spring element, after shifting the spring element 6 vertically from the kink 13 of the tunnel-shaped recess 5 of the sliding chair, comes into engagement with the kink 13, so that there becomes effective only the area b between the kink 13 and the end 14 of the spring element facing the rail foot 1, which corresponds to a progressive spring characteristic. The spring path of this section b is, in this case, limited by abutment on the steeper area 12 of the upper edge of the tunnel-shaped recess 5 of the sliding chair 3.

Figure 2:
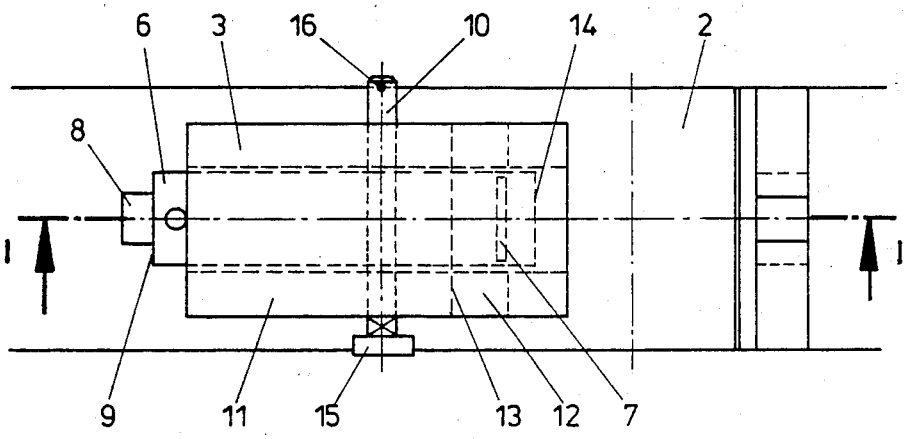
FIG. 2 shows a top plan view of the embodiment according to FIG. 1 after having removed the stock rail, noting that FIG. 1 shows a section along line I—I of FIG. 2.

In the representation according to FIG. 2, the reference signs of FIG. 1 have been maintained. FIG. 2 depicts the cross wedge 10 being limited by a head 15, noting that the position of the cross-wedge 10, for example, can be secured by a splint 16.

Figure 3:
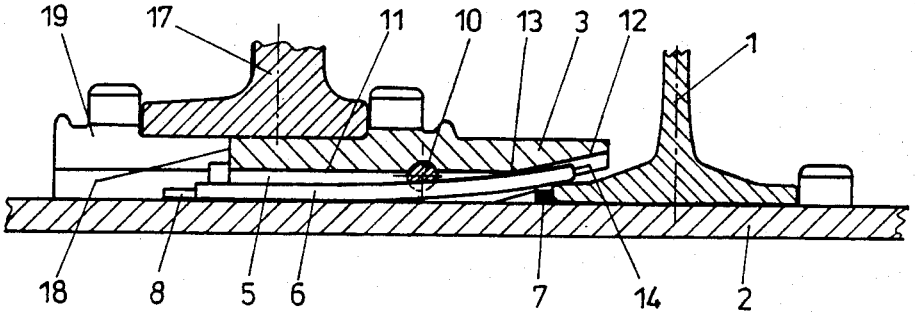
FIG. 3 shows a second embodiment of a device for fixing rails in railway switches in connection with an embodiment having the stock rail mounting located at the inner side.
Figure 4:
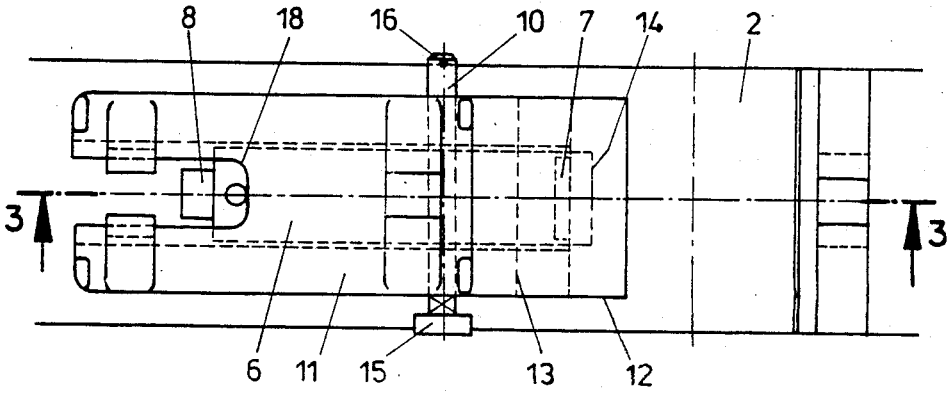
FIG. 4 shows a top plan view of the embodiment according to FIG. 3, noting that FIG. 3 shows a section along line III—III of FIG. 4.

In FIGS. 3 and 4, the reference numerals of FIGS. 1 and 2 have been maintained for similar parts. The sliding chair 3 has again a tunnel-shaped recess 5 having its upper edge delimited by two areas 11 and 12 extending with different inclinations and along straight lines and forming therebetween a kink 13. The spring-like element 6 is pre-tensioned by a cross-wedge 10, noting that in the rest position there is a vertical distance between the kink 13 and the surface of the plate-shaped element 6. A spring tongue 17, in the embodiment according to FIG. 3, is shown on the sliding chair 3, noting that for the purpose of holding the spring tongue 17 in position, the sliding chair 3 has an U-shaped recess 18 allowing connection of fastening elements 19 for the spring tongue 17 with the base plate 2.

Analogous to the action of the embodiment according to the FIGS. 1 and 2, there becomes, in the case of a tilting movement of the stock rail 1, first effective on the rail foot a force corresponding to the total length of the spring element 6 until the spring element 6 comes into contact with the kink 13. On further tilting there becomes effective on the rail foot 1 a progressive spring force corresponding to the area of the spring element between the kink 13 and the end 14 facing the rail foot until the steeper area 12 of the upper edge of a tunnel-shaped recess 5 facing the rail foot 1 again forms an abutment for the spring element 6.

What is claimed is:

1. A device for fixing stock rails in railway switches, comprising:

a base plate for the stock rail; and a sliding chair for a switch tongue mounted on said base plate, said chair including an elongated spring element for pressing down a rail foot and having the shape of a plate, said spring element extending through a tunnel-shaped recess within the sliding chair and said recess extending approximately in a direction normal to the stock rail, with the spring element being introduced into the recess of the sliding chair with a tension being insufficient for holding down the rail foot, at least one wedge being provided that is independent from the sliding chair and from the rail foot and by means of which the spring element can be put against the rail foot under tension;

wherein an upper edge of the tunnel-shaped recess within the sliding chair extends, under the formation of a kink, steeper in direction towards the rail foot than within an area of smaller inclination located in front of said kink and wherein the independent wedge can be run in the recess within the area of smaller inclination of the upper edge at a distance from the kink of the upper edge.

2. A device as claimed in claim 1, wherein the upper edge of the tunnel-shaped recess is formed of two sections extending along straight lines that join in a salient angle.

3. A device as claimed in claim 2, wherein the salient angle is selected between 185° and 205°.

4. A device as claimed in any of claims 1, 2 or 3, wherein a distance between the wedge and the end of spring element overriding the rail foot is 25 to 100 percent greater than a second distance between the kink of the upper edge and the end of the spring element overriding the rail foot.

5. Process for fixing stock rails by means of a device according to any of the claims 1 to 3, wherein the wedge is driven in in such a manner that the spring element is brought into a predetermined vertical distance from the location of the kink within the tunnel-shaped recess.

* * * * *